US005482486A

United States Patent [19]

Vaudaine et al.

[11] Patent Number: 5,482,486

[45] Date of Patent: Jan. 9, 1996

[54] PROCESS FOR THE PRODUCTION OF A MICROTIP ELECTRON SOURCE

[75] Inventors: Pierre Vaudaine, Seyssins; Brigitte Montmayeul, Brignoud; Michel Borel, St. Vincent de Mercuze, all of France

[73] Assignee: Commissariat a l'Energie Atomique, Paris, France

[21] Appl. No.: 266,465

[22] Filed: Jun. 27, 1994

[30] Foreign Application Priority Data

Jul. 12, 1993 [FR] France ..... 93 08556

[51] Int. Cl.[6] ..... H01J 9/42

[52] U.S. Cl. ..... 445/3; 445/50

[58] Field of Search ..... 445/3, 24, 50

[56] References Cited

U.S. PATENT DOCUMENTS

| | | | |
|---|---|---|---|
| 3,817,592 | 6/1974 | Swanson | 445/3 |
| 4,324,999 | 4/1982 | Wolfe | 445/3 |

FOREIGN PATENT DOCUMENTS

| | | |
|---|---|---|
| 0461990 | 12/1991 | European Pat. Off. . |
| 2593953 | 8/1987 | France . |
| 2623013 | 5/1989 | France . |
| 2687839 | 8/1993 | France . |

*Primary Examiner*—P. Austin Bradley
*Assistant Examiner*—Jeffrey T. Knapp
*Attorney, Agent, or Firm*—Oblon, Spivak, McClelland, Maier & Neustadt

[57] ABSTRACT

A method for forming a microtip electron source includes the steps of forming a first microtip electron source using a mask, determining deviations in the structure of the first microtip electron source from a structure which should theoretically have been obtained using the first mask, and then correcting the first mask used during fabrication of the first microtip electron source that are designed to generate additional deviations that compensate for the effects upon performance of the deviations determined in the first microtip electron source when subsequent microtip electron sources are fabricated using the mask.

10 Claims, 4 Drawing Sheets

PROCESS FOR THE PRODUCTION OF A MICROTIP ELECTRON SOURCE

BACKGROUND OF THE INVENTION

1. Field of the Invention

The present invention relates to an improvement to a process for the production of a microtip electron source. It makes it possible to improve the uniformity and/or reproducibility of the emission of microtip cathodes and reduce the manufacturing constraints.

2. Discussion of the Background

Emissive microtip cathodes are electron sources more particularly used in the display field, more specifically for flat-face screens. They can also be used in electron guns or vacuum gauges.

FR-A-2 593 953 describes a process for the production of a display means by cathodoluminescence excited by field emission. The electron source is a microtip cathode deposited on a glass substrate and having a matrix structure.

Figure 1:
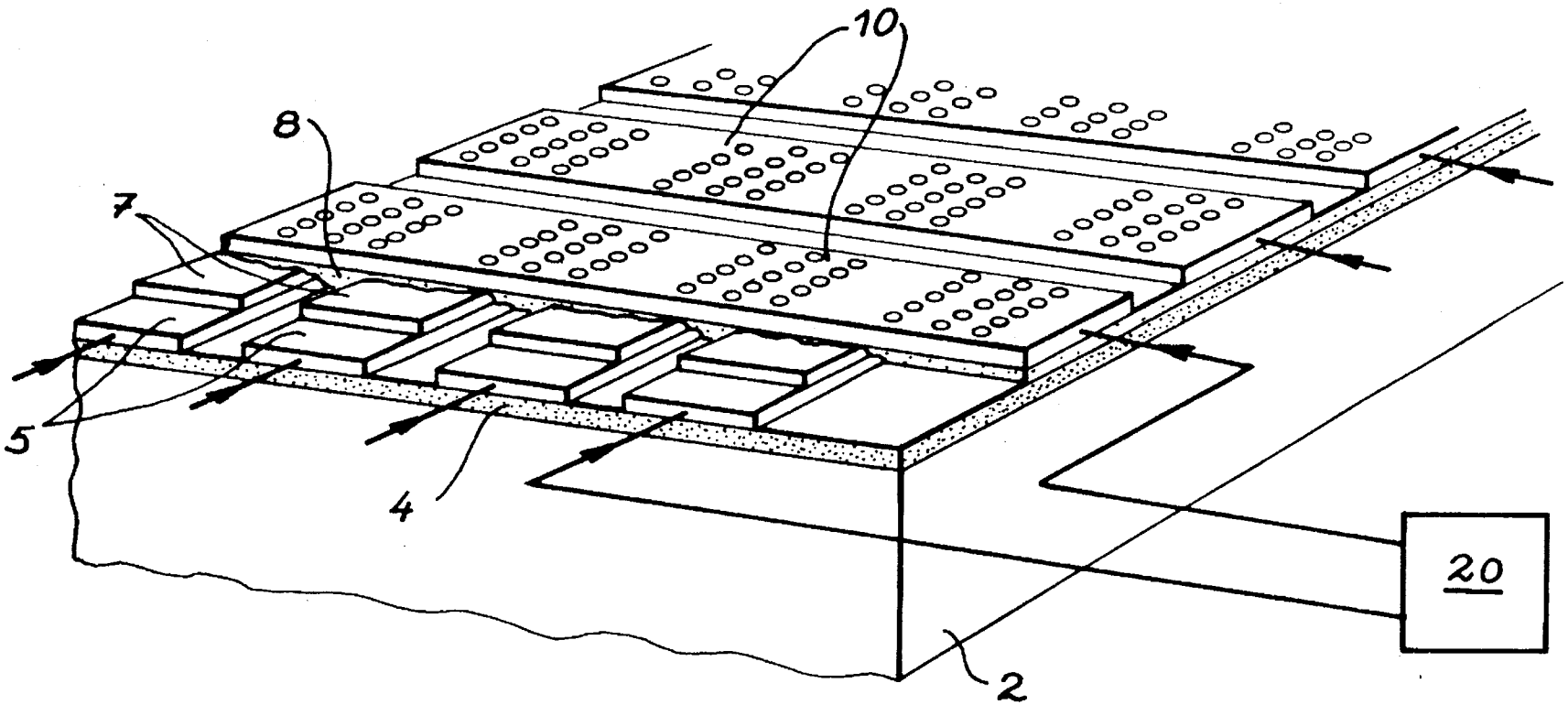
FIG. 1 PRIOR ART

FR-A-2 623 0 13 and FR-A-2 663 462 describe improvements made to said microtip cathode. They more particularly relate to the improvement of the emission uniformity by limiting the current in the tips which emit the most electrons. This result is obtained by introducing a resistor in series with the microtips. This resistor is formed from a continuous or non-continuous resistive layer. FIG. 1 diagrammatically shows a known electron source having microtip missive cathodes described in detail in FR-A- 2 623 013. This source has a matrix structure and optionally incorporates a thin silica layer 4 on an e.g. glass substrate 2. On said silica layer 4 are formed a plurality of electrodes 5 in the form of parallel conductive strips serving as cathode conductors and constituting the columns of the matrix structure. The cathode conductors are in each case covered by a resistive coating 7, which can be continuous (except at the ends in order to permit the connection of the cathode conductors to polarization means 20). A silica, electrically insulating coating 8 covers the resistive coating 7. Above the insulating coating 8 are formed a plurality of electrodes 10 also in the form of parallel conductive strips. These electrodes 10 are perpendicular to the electrodes 5 and serve as grids forming the lines or rows of the matrix structure. A resistive coating can optionally be deposited above or below the electrodes 10.

FR-A-2 663 462 recommends the use of electrodes (e.g. cathode conductors) in lattice form, in such a way that the microtips are located in the openings of the lattice of said electrodes. In this configuration the breakdown resistance is no longer mainly dependent on the thickness of the resistive coating, but instead on the distance between the cathode conductor and the microtip.

Another improvement to said microtip cathodes is provided by French patent application 92 02 220 of Feb. 26, 1992, now FR 2,687,839, in the name of the present applicant. These improvements consist of reducing short-circuiting risks between the rows and columns by means of microtips. In order to do this, there is a maximum reduction of the overlap zones of the two series of electrodes, as illustrated in the attached FIGS. 2 and 3.

Figure 2:
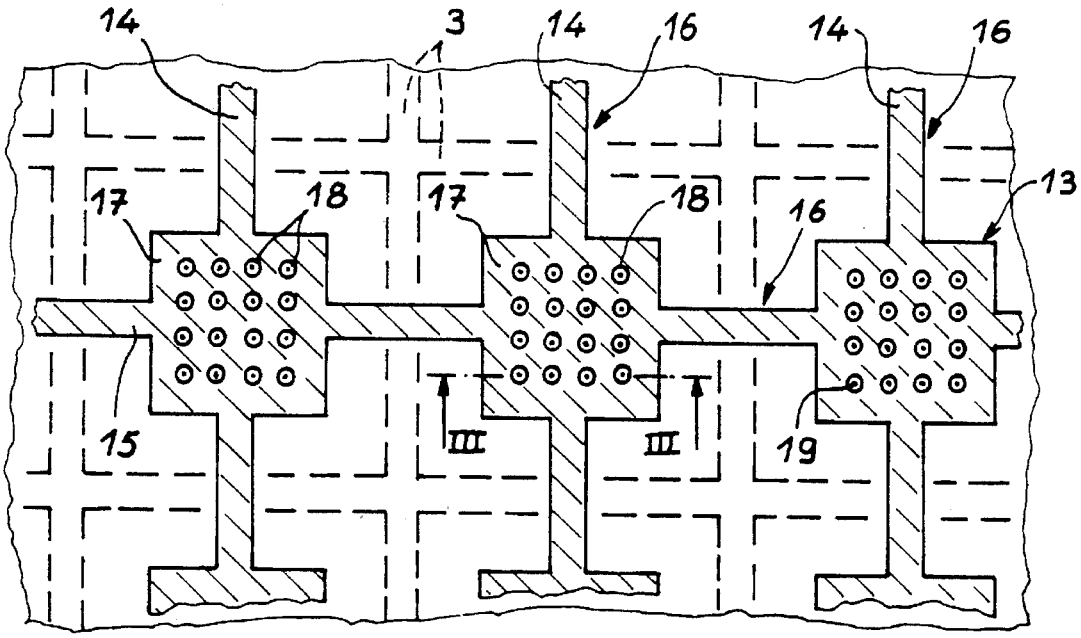
FIG. 2 PRIOR ART
Figure 3:
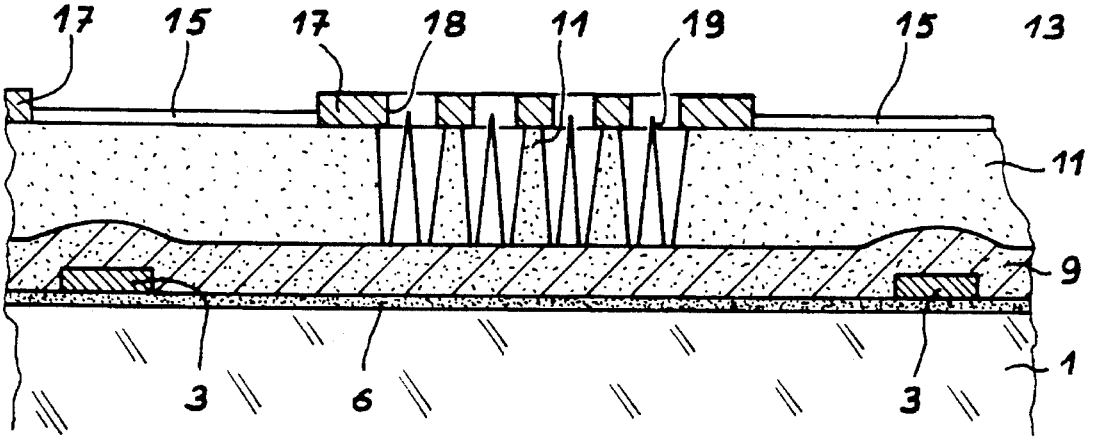
FIG. 3 PRIOR ART

FIG. 2 is a diagrammatic plan view of the electron source and FIG. 3 a larger scale sectional view along axis III—III of FIG. 2. This matrix structure comprises an e.g. glass substrate 1 and optionally a thin silica coating 6. On said silica coating 6 is formed a series of parallel electrodes 3, each having a lattice structure and serving as cathode conductors, forming the columns of the matrix structure.

The cathode conductors 3 are covered by the silicon resistive coating 9 and by the silica insulating coating 11. Above the insulating coating 11 is formed another series of parallel electrodes also having a perforated, but differing structure designed to minimize the overlap zones with the cathode conductors. These electrodes are perpendicular to the cathode conductors and form the grids, being the rows of the matrix structure.

FIGS. 2 and 3 show in detail one of the grids of the device. The grid 13 has parallel tracks 14 orthogonally intersecting other parallel tracks 15. At the intersections of the tracks 14 and 15, the grid has widened zones 17, which are square here. FIG. 2 shows the overlap zone 16 of the cathode conductor 3 and the tracks 14 and 15 of the grid with a very small surface. The widened zones 17 are located in the center of the meshes forming the cathode conductor.

In the intersection zones of the cathode conductors and the grids, microholes 18 are formed in the thickness of the grid and the insulating coating 11. Microtips 19 are deposited in these holes and rest on the resistive coating 9. A microhole and microtip assembly constitutes an electron microemitter. The microemitters occupy the central regions of the meshes of the lattice of the cathode conductor and the widened, square zones 17 of the grid. In the case shown in FIGS. 2 and 3, each of the meshes of the cathode conductor and each widened grid zone has 16 microemitters.

The dimensions of the microemitters are optimized in order to obtain the best possible emission. It is a question of the diameter of the holes, the geometry of the tips, the thickness of the insulating coating and the thickness of the grid. Thus, the emission current is highly dependent on these dimensions and is inversely proportional to the diameter of the holes. It is of an optimum nature when the holes are circular and decreases when the holes lose this circular shape, e.g. when they become oval. The emission current is also at an optimum when the apex of the tips is located in the thickness of the grid conductor and drops very rapidly when the tips are high and project above the grid and when they are low, their apex remaining below the grid. The position of the apex of the tips is linked with the thickness of the insulating coating in which are etched the holes and with the geometry of the tips, particularly the angle of the cone which they form.

The apex of the tips is located in the grid thickness in exemplified manner when the following conditions are fulfilled:

thickness of the insulating coating 11=1 μm, diameter of the holes 18=1.3 μm, molybdenum tips 19 deposited by evaporation or sputtering perpendicular to the surface, grid thickness in the widened zone=0.4 μm.

Despite the improvement to the emission uniformity resulting from the successive improvements disclosed in the aforementioned documents, inhomogeneities have been found associated with defects in the structure of the microtip cathodes. These defects can be due to inadequacies of the microemitter production processes. They can also be due to a lack of planarity on the part of the substrate on which the cathode is produced.

Among the defects found reference can be made to the lack of uniformity of the diameter or shape of the microholes or the poor reproducibility of these parameters (diameter, shape) between individual screens and the poor alignment between the emissive tips and the grids, so that certain tips do not emit.

This is due to an inadequate control of the production parameters and/or due to imperfections in the equipments used. The emitted current is constant when the apex of the tips remains within the thickness of the grid and the diameter of the holes is constant. If, in the emissive surface of a cathode or between individual cathodes, the diameter of the holes varies in an uncontrolled manner, or if the tips pass out of the thickness of the grids, the emitted current will vary and the uniformity of emission or its reproducibility is no longer ensured. Thus, the emission is affected if the manufacturing parameters pass outside the admissible tolerance range for obtaining the requisite dimensions for the microemitters.

However, the equipments used for the manufacture of the emissive cathode are not perfect and their performance characteristics are only optimum and reproducible within a certain tolerance. If this tolerance is broader than that of the emissive structure, the emission characteristics are affected. Moreover, certain defects are caused or made worse by the substrate, particularly its lack of planeity.

SUMMARY OF THE INVENTION

The invention aims at obviating these disadvantages by intervening on a mask used during the manufacture of microtip cathodes for deliberately forming defects regularly distributed in accordance with a sufficiently fine periodicity to make them invisible and within a sufficiently large shape or dimensional range or in a sufficient number to swamp all the defects, no matter whether they are deliberate or not.

The invention therefore relates to an improvement to a process for the production of a microtip electron source, the microtips being electrically connected to at least one cathode conductor and being located in holes made in at least one electron extraction grid, the process using a masking stage for producing the holes in the grid by means of a mask having corresponding holes, the holes in the mask having given dimensions and shapes in order to theoretically lead to the obtaining of holes in the grid having dimensions, shapes and positions within the given tolerances, the apices of the microtips being located in the thickness of the grid, the improvement being characterized in that after producing an electron source according to said process:

an evaluation is made to establish whether the source has an emission which is sufficiently homogeneous and/or reproducible and/or reproducible on another source, if the emission of the source is considered to be inhomogeneous and/or non-reproducible, a determination takes place of the defects leading to said inhomogeneous emission and which are due to shapes, dimensions or positions of the holes falling outside the tolerances or because the apices of the microtips are not located in the thickness of the grid, the mask used during the process is corrected in order to render homogeneous and/or reproducible the future sources produced by said process, the correction consisting of modifying the shapes and/or dimensions of at least certain holes in the mask and/or the number of holes in the mask in order to compensate for the previously determined defects by creating supplementary defects and/or holes.

If the defects are due to a variation outside the tolerances of the diameter of the holes of the grid, the mask is corrected so as to give it, over its entire surface, holes having diameters varying according to a distribution making it possible to include these manufacturing defects.

If the defects are due to the presence of oval grid holes, the mask is corrected so as to provide it, over its entire surface, with circular holes and oval holes, whose major axes are located in the direction of the minor axes of the oval holes of the defective grid, the circular and oval correcting holes being readily mixed on the mask.

If the defects are due to an unsatisfactory positioning of the holes with respect to the grid, there is an increase in the number of holes in the mask in such a way that the grid of the future sources is provided with a number of holes equivalent to a good positioning of the holes with respect to the grid.

The hole production process can advantageously be a photolithographic process.

The invention is described in greater detail hereinafter relative to non-limitative embodiments and with reference to the attached drawings, wherein they show:

FIG. 1 Diagrammatically a prior art microtip emissive cathode electron source.

FIGS. 2 and 3 A microtip electron source for which the cathode conductors and the grids have a lattice structure.

Figure 4:
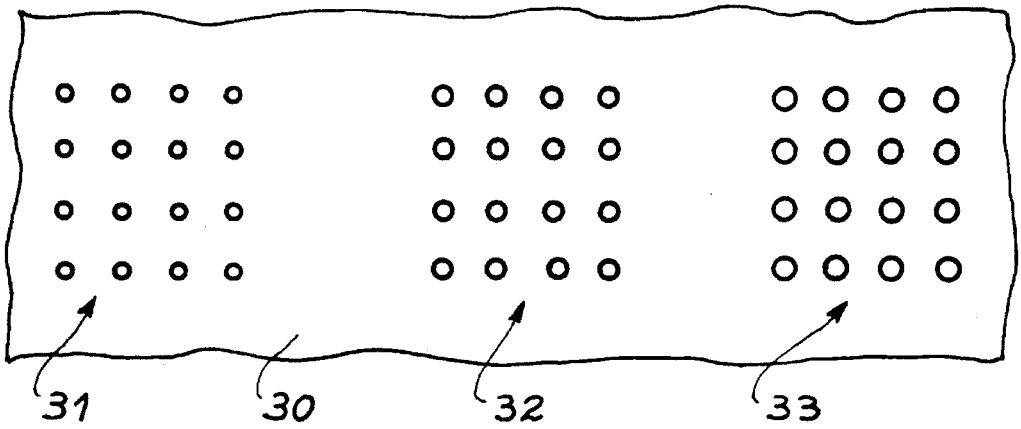
Figure 5:
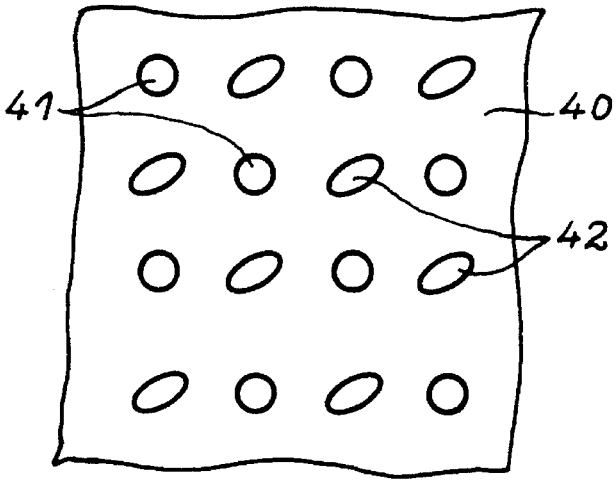

FIGS. 4 and 5 Parts of masks used during the implementation of the improved process according to the invention.

Figure 6:
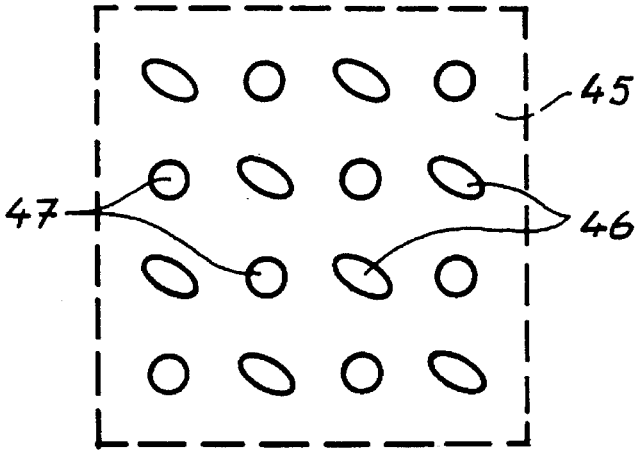

FIG. 6 The shapes of holes made on the mesh of the emissive structure after implementing the improved process according to the invention.

Figure 7:
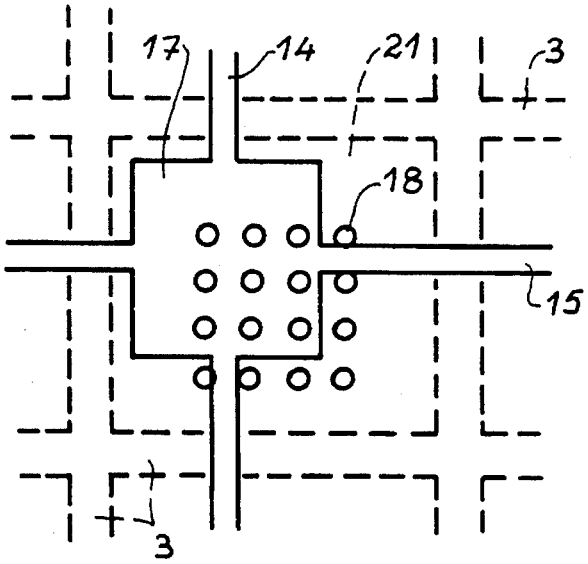

FIG. 7 A structure defect on a prior art microtip electron source.

Figure 8:
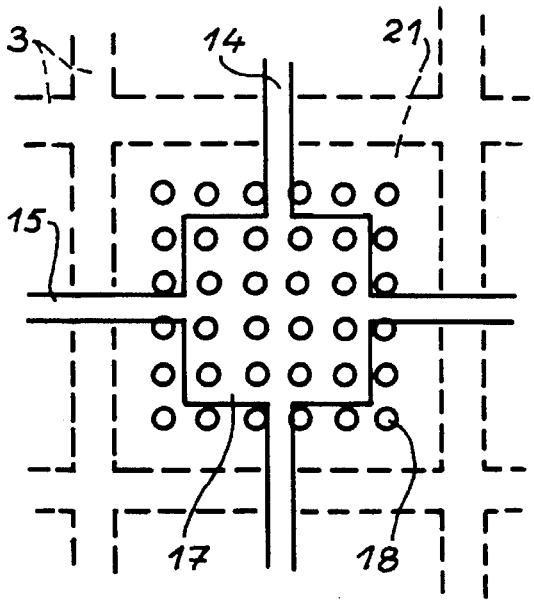
Figure 9:
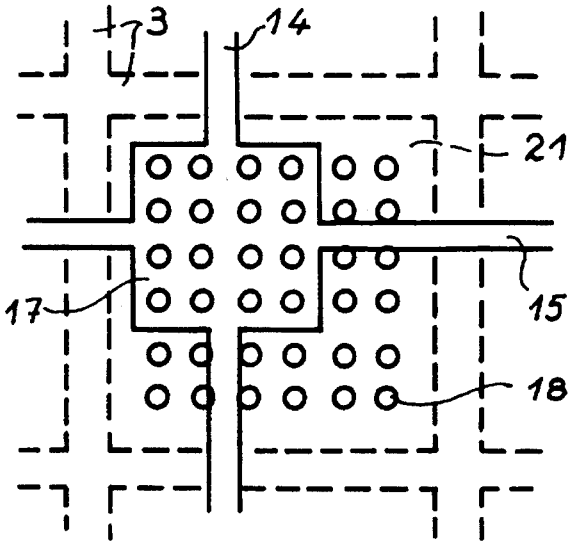

FIGS. 8 and 9 The results obtained on a microtip electron source after implementing the improved process according to the invention.

The emissive structure illustrated by FIGS. 2 and 3 can advantageously be obtained by a known process, which is briefly described below.

On the, e.g., glass insulating substrate 1 covered with a thin, approximately 1000 Angström silicon coating 6, is deposited a metallic coating e.g. by cathodic sputtering. This metallic coating can be a 2000 Angström thick niobium coating.

From the previously deposited metallic coating are produced the cathode conductors 3 by giving them a lattice shape, which can be carried out by photolithography and reactive ionic etching.

This is followed by the deposition, e.g. by cathodic sputtering, of the doped silicon resistive coating 9, whose thickness can be 5000 Angströms.

On the resistive coating 9 is deposited an e.g. silica, insulating coating 11 by chemical vapour deposition (CVD) or by cathodic sputtering. Preference is given to the use of chemical vapour deposition, which makes it possible to obtain an oxide coating of homogeneous quality and constant thickness.

On the insulating coating 11 is deposited e.g. by vacuum evaporation an approximately 4000 Angström thick niobium coating from which are formed the grid conductors by photolithography and reactive ionic etching.

The holes which are to house the microtips are formed by a photolithographic method. For this purpose, a photosensitive resin coating is spread on the grid conductors or the exposed areas of the insulating coating 11 and then dried in the oven. The resin coating is irradiated with ultraviolet rays through an opaque mask provided with holes corresponding to the holes to be obtained on the grid conductors and insulating coating. For this purpose, the mask has been positioned with respect to the substrate in such a way as to obtain the grid holes at the desired locations.

The same hole mask is used for all the substrates. In the case of proximity irradiation, said mask is at scale 1 and covers the entire emissive surface. In case of an irradiation by photo-repeater, it can be at scale 5 and will only cover a fraction of the emissive surface. The elementary irradiation stage is then repeated for the number of times necessary to cover the entire emissive surface.

After irradiation, the substrate is immersed in a developer bath in order to open the holes in the resin. A dry etching process makes it possible to etch the holes in the grid conductors and then in the insulating coating 11, the resin coating serving as a mask. Finally, the resin coating is removed, e.g. by a wet chemical process.

The microtips are formed in three stages. Firstly, a nickel coating is deposited by vacuum evaporation or sputtering and under a pronounced incidence with respect to the perpendicular to the substrate in such a way that the nickel is only deposited on the upper face of the structure and on the sides of the holes of the grid previously etched in the structure, but not on the bottom of the holes made in the insulant. By vacuum evaporation, deposition takes place of the material which is to form the tips 19 in accordance with a direction perpendicular to the substrate, so as to deposit said material on the previously deposited nickel coating and also on the bottom of the holes. As the new coating, e.g. of molybdenum grows, the holes become progressively blocked and a cone (microtip) is formed in each hole. Deposition is stopped when the holes are blocked.

The nickel coating is then dissolved by an electrochemical process, which makes it possible to remove the molybdenum coating which it supports on the upper face of the structure, whilst retaining the tips in the holes. Therefore the tips are automatically centered in the holes. Their height is dependent on the angle of the cone, which is linked with the deposition parameters and the diameter of the holes. For a constant cone angle, the wider the holes, the higher the tips and vice versa.

An inhomogeneous emission of a microtip cathode can be caused by an excessive variation in the diameter of the holes on the structure forming the cathode. If e.g. irradiation took place with a photo-repeater carrying out its readjustment for each stage, said adjustment can be locally disturbed by planeity defects of the substrate. Thus, e.g. certain zones of the structure fall outside the field depth and consequently the holes are too small. To remedy this defect, over the emissive surface holes of different diameters are mixed so as to always have a certain number of microemitters emitting at their optimum level. The global emission level is decreased, but is uniform.

The correction on the mask consequently consists of providing it with holes having different diameters regularly distributed over the emissive surface. FIG. 4 shows part of a mask 30 for forming microholes in a microtip cathode structure used for a fluorescent screen. This part of the mask comprises three adjacent groups of holes 31, 32 and 33 corresponding to three adjacent meshes defined by the cathode conductors on the cathode. These three meshes constitute an elementary group. It is necessary to have several of these elementary groups in order to contribute to the formation of a pixel on the screen.

Each mesh e.g. comprises 16 microemitters emitting at their optimum level when the diameter of the microholes is 1.3 μm, as stated hereinbefore. On the mask, the group 31 is formed by holes having a diameter of 1.1 μm, i.e. theoretically producing 1.1 μm holes on the emissive structure. The group 32 is formed by diameter 1.3 μm holes, i.e. theoretically producing 1.3 μm holes on the emissive structure. The group 33 is formed by diameter 1.5 μm holes, i.e. theoretically producing 1.5 μm holes on the emissive structure. Therefore, the emissive structure comprises a distributed arrangement of groups such as 31, 32 and 33.

In the zones of the emissive structure where the holes of the mask have been correctly transferred, the microemitters corresponding to groups 32 will emit in an optimum manner. The other microemitters corresponding to groups 31 and 33 would have a very reduced emission. If in other zones of the emissive structure the transfer of the mask holes was unsatisfactorily performed and there was consequently a diameter increase of the microholes of the electron source by 0.2 μm, the microemitters corresponding to groups 31 would emit in an optimum manner. The other microemitters corresponding to groups 32 and 33 would have a very reduced emission. The same reasoning applies for groups 33 in the case of a 0.2 μm diameter reduction. Thus, there is always the same number of microemitters emitting in an optimum manner distributed in a uniform way over the entire source, which consequently emits homogeneously.

It obviously falls within the scope of the present invention to mix on the mask more than three different hole diameters.

An inhomogeneous emission of a microtip cathode can also be due to a deterioration in the shape of the holes transferred to the emissive structure. An aberration of the optics of the irradiation equipment can lead to oval holes being obtained inclined e.g. by 45° to the left. Thus, on the basis of a mask uniformly having circular holes, it is possible to obtain on the emissive structure zones having circular holes corresponding to an aberration-free optics and zones having all oval holes, which are also inclined and which correspond to an optics having an aberration.

The correction to be made on the mask then consists of regularly mixing over the entire mask surface circular holes and oval holes inclined by 45° to the right. FIG. 5 shows a part of such a correcting mask with 16 holes corresponding to a mesh of the emissive structure. It can be seen that this consists of eight circular holes 41 and eight oval holes 42 inclined to the right, the circular and oval holes being regularly distributed. On the mask, all the groups of holes are identical to those shown in FIG. 5.

During the transfer to the emissive structure, in the zones corresponding to an aberration-free optics, the holes reproduced on the emissive structure will be identical to those of the corresponding part of the mask. In the zones corresponding to an optics with aberration, the holes reproduced on the emissive structure will be deformed compared with those of the corresponding part of the mask. In this case, FIG. 6 shows the shapes of the holes reproduced on a mesh 45 of the emissive structure by the holes of the mask 40 of FIG. 5. To the circular holes 41 of the mask correspond oval holes 46 inclined to the left on the emissive structure. To the oval holes 42 inclined to the right correspond circular holes 47 on said emissive structure.

On the emissive structure there are the same number of inclined oval holes as there are circular holes, the oval holes inclined to the left and right giving the same emission level for the microemitters. Thus, the emission level of the cathode is homogeneous over the entire emissive surface.

An inhomogeneous emission of a microtip cathode can also be linked with an inadequately satisfactory positioning of the grids with respect to the microtips. In certain cases the misalignment is sufficiently large (exceeding 2 μm) for the holes to be outside the widened zones reserved for them in the grid. FIG. 7 gives an example of such a misalignment.

The widened, square zone 17 is not centered in the mesh 21 defined by the cathode conductor 3. With respect to the sixteen microemitters shown, seven are outside the zone 17 and do not emit.

In order to obviate this deficiency, within the mesh there is a size increase of the zone covered by the holes 18 to beyond the square zone 17, in such a way that the latter is offcentered in the mesh, but still covers the same number of microtips. For this purpose it is merely necessary to increase the number of holes in the mask so as to transfer the desired number of holes. For example, in order to still have sixteen operating microemitters, for one mesh it is possible to provide 36 holes arranged in the form of a square on the corresponding part of the mask. FIG. 8 shows the result obtained for a square zone 17 centered in the mesh 21. FIG. 9 shows the result obtained for a square zone 17 offcentered with respect to the mesh 21. In both cases, there are always sixteen operating microemitters.

It falls within the scope of the invention to combine, if appropriate, on the same mask the different corrections to be made thereto in order to solve several problems, e.g. to correct defects due to a lack of substrate planeity, those due to an aberration of the optics of the irradiation equipment and those due to alignment problems.

Moreover, although the invention has been described in exemplified manner with respect to a source having lattice-type electrodes, it is obviously applicable to all types of microtip electron sources.

We claim:

1. An improvement in a method for fabricating a microtip electron source that comprises microtips which are electrically connected to at least one cathode conductor, located in holes that are formed from at least one electron extraction grid, the process of forming the holes comprising the step of masking a first electron extraction grid with a mask, the improvement in the process comprising the steps of:

determining deviations from desired shapes, dimensions, and positions, of the shapes, dimensions, and positions of the holes of the first electron extraction grid;

modifying the mask so that use of the mask for fabrication of a second electron extraction grid provides shapes, dimensions, and positions of holes in the second electron extraction grid which provide at least one of improved electron emission characteristics and improved reproducibility for the second electron extraction grid relative to the first electron extraction grid.

2. The improved process according to claim 1, wherein the step of modifying the mask comprises the step of increasing the number of holes in the mask.

3. The improved process according to claim 1, wherein the structures of the mask providing the holes are regularly spaced from one another.

4. The improved process according to claim 1, wherein the step of modifying provides improved electron emission characteristics for the second electron extraction grid relative to the first electronic extraction grid.

5. The improved process according to claim 1, wherein the step of modifying provides improved reproducibility for the second electron extraction grid relative to the first electronic extraction grid.

6. The improved process according to claim 1, wherein the process of forming the holes comprises photolithography.

7. The improved process according to claim 1, wherein the step of modifying the mask comprises the step of modifying the mask to provide holes in the second electron extraction grid which have various diameters.

8. The improved process according to claim 1 or 7, wherein the step of modifying the mask comprises the steps of modifying the mask to provide both circular and oval holes in the mask, the oval holes including oval correcting holes.

9. The improved process according to claim 8, wherein said first electron extraction grid comprises oval holes and the oval correcting holes provided in the modified mask have their major axis along the direction of the minor axis of the oval holes of the first electron extraction grid.

10. The improved process according to claim 9, wherein the oval correcting holes are homogeneously spaced on the mask.

* * * * *